US006892476B2

(12) United States Patent
Forget et al.

(10) Patent No.: US 6,892,476 B2
(45) Date of Patent: May 17, 2005

(54) CLOTHES DRYER WITH MOVABLE REAR PANEL SPACER

(75) Inventors: Francis Forget, Laval (CA); Michael Piplakis, Laval (CA)

(73) Assignee: Camco Inc., Mississauga (CA)

( * ) Notice: Subject to any disclaimer, the term of this patent is extended or adjusted under 35 U.S.C. 154(b) by 49 days.

(21) Appl. No.: 10/678,106

(22) Filed: Oct. 6, 2003

(65) Prior Publication Data

US 2004/0078995 A1 Apr. 29, 2004

(30) Foreign Application Priority Data

Oct. 24, 2002 (CA) ..... 2409727

(51) Int. Cl.[7] ..... F26B 11/02
(52) U.S. Cl. ..... 34/603; 34/595; 34/604
(58) Field of Search ..... 34/595, 603, 604, 34/607, 608, 609, 610; 249/5; 211/38; 248/188, 188.1, 188.6, 188.7, 188.8

(56) References Cited

U.S. PATENT DOCUMENTS 3,016,595 A * 1/1962 Durst ..... 264/32
4,635,895 A * 1/1987 Johnson et al. ..... 249/5
4,890,396 A 1/1990 King
5,121,948 A 6/1992 Anderson et al.
5,257,468 A 11/1993 Lebrun
5,881,474 A 3/1999 Berger
6,230,418 B1 5/2001 Gomulinski
6,349,907 B1 * 2/2002 Hollington et al. ..... 248/188.4
6,370,794 B1 4/2002 Tuggle

* cited by examiner

*Primary Examiner*—Denise L. Esquivel
*Assistant Examiner*—Kathryn S. O'Malley

(57) ABSTRACT

A clothes dryer has a rear panel and an exhaust vent passing through the rear panel. The exhaust vent is adapted to be connected with a flexible venting hose. The spacer is pivotally mounted to the rear panel of the clothes dryer for movement between an upright shipping position extending adjacent the dryer rear panel and a lowered position extending out and away from the dryer rear panel for maintaining a predetermined distance between the rear panel of the dryer and a room wall adjacent to which the clothes dryer is adapted to be positioned. The spacer has a cover member which is adapted to at least partially cover the exhaust vent when the spacer is in the upright position to prevent connection of a flexible venting hose to the dryer exhaust vent. The spacer of the present invention insures that a predetermine distance is maintained between the rear panel of the dryer and a room wall adjacent to which the dryer is positioned so as to prevent kinking of the flexible heating hose.

7 Claims, 3 Drawing Sheets

CLOTHES DRYER WITH MOVABLE REAR PANEL SPACER

FIELD OF THE INVENTION

The present invention relates to a clothes dryer having a spacer mounted to its rear panel and movable therewith to space the rear panel of the dryer a predetermined distance from a room wall against which the dryer may be positioned.

BACKGROUND OF THE INVENTION

A domestic clothes dryer usually has either an electrical heating element or a gas heating element heating air forced through a rotating drying drum and out through an exhaust vent. The exhaust vent extends through a rear panel of the dryer. Clothing placed in a drum is dried by the hot air flow through the drum. Venting is connected to the dryer exhaust vent so as to exhaust air from the clothes dryer to the venting and to the environment outside of a room. In most instances, the clothes dryer is positioned within a room adjacent a wall such that the rear panel of the clothes dryer is located adjacent to this room wall. Often, a flexible hose is used for venting gas from the dryer to outside the room.

Typically the flexible hose is connected to the exhaust vent of the dryer prior to the clothes dryer being positioned adjacent a wall in the room. As the dyer is moved towards this room wall, the flexible hose has a tendency to flex and in some instances kink thereby restricting the flow of air through the flexible hose.

A clothes dryer having a flexible hose support is disclosed in U.S. Pat. No. 5,881,474 issued Mar. 6, 1999 to Edwin L. Berger. This patent teaches the use of a bracket which allows for the flexible hose to be wrapped in a helical fashion around the bracket so as to prevent kinking. However, the problem associated with this particular bracket is that there is still an opportunity for the hose to kink as the clothes dryer is being pushed back towards the room wall. Accordingly, there is a need to provide some a solution that reliably prevents the kinking of a flexible hose connected to exhaust vent of the dryer.

SUMMARY OF THE INVENTION

The present invention relates to a clothes dryer having a rear panel with an exhaust vent passing through the rear panel. The clothes dryer rear panel has mounted thereto a spacer which is moveable between an upright position against the dryer rear panel and a lower position for maintaining a predetermined space between the rear panel and any wall adjacent to which the dryer is to be positioned. The spacer maintains a predetermined distance which is sufficient to prevent the dryer rear panel from being pushed too close to the room wall and kinking or collapsing the flexible vent hose as the vent hose is spaced between the dryer rear panel and the room wall.

It is envisaged that the spacer may be movably mounted to the rear panel for movement between an upright shipping position extending adjacent the dryer rear panel and a lowered position extending out and away from the dryer rear panel for maintaining a predetermined distance between the rear panel the dryer and a room wall adjacent to which the clothes dryer is adapted to be positioned. The spacer effectively functions in its lowered position as a stopper limiting movement of the dryer towards the room wall.

It is further envisage that the spacer may include a cover portion that at least partially covers the exhaust vent of the dryer when the spacer is in its upright shipping position to prevent connection of the flexible venting hose to the dryer exhaust vent. Further, it is envisaged that the spacer may be pivotally mounted to the dryer panel below the dryer exhaust vent.

In order to maintain the predetermined distance between the room wall and the dryer rear panel, the spacer need not necessarily extend directly out from the dryer rear panel. It is believed that the spacer can extend on an angle downwardly or upwardly from the dryer rear panel.

BRIEF DESCRIPTION OF THE DRAWINGS

For a better understanding of the nature and objects of the present invention, reference may be had to the accompanying diagrammatic drawings in which.

DETAILED DESCRIPTION OF THE INVENTION

Figure 1:
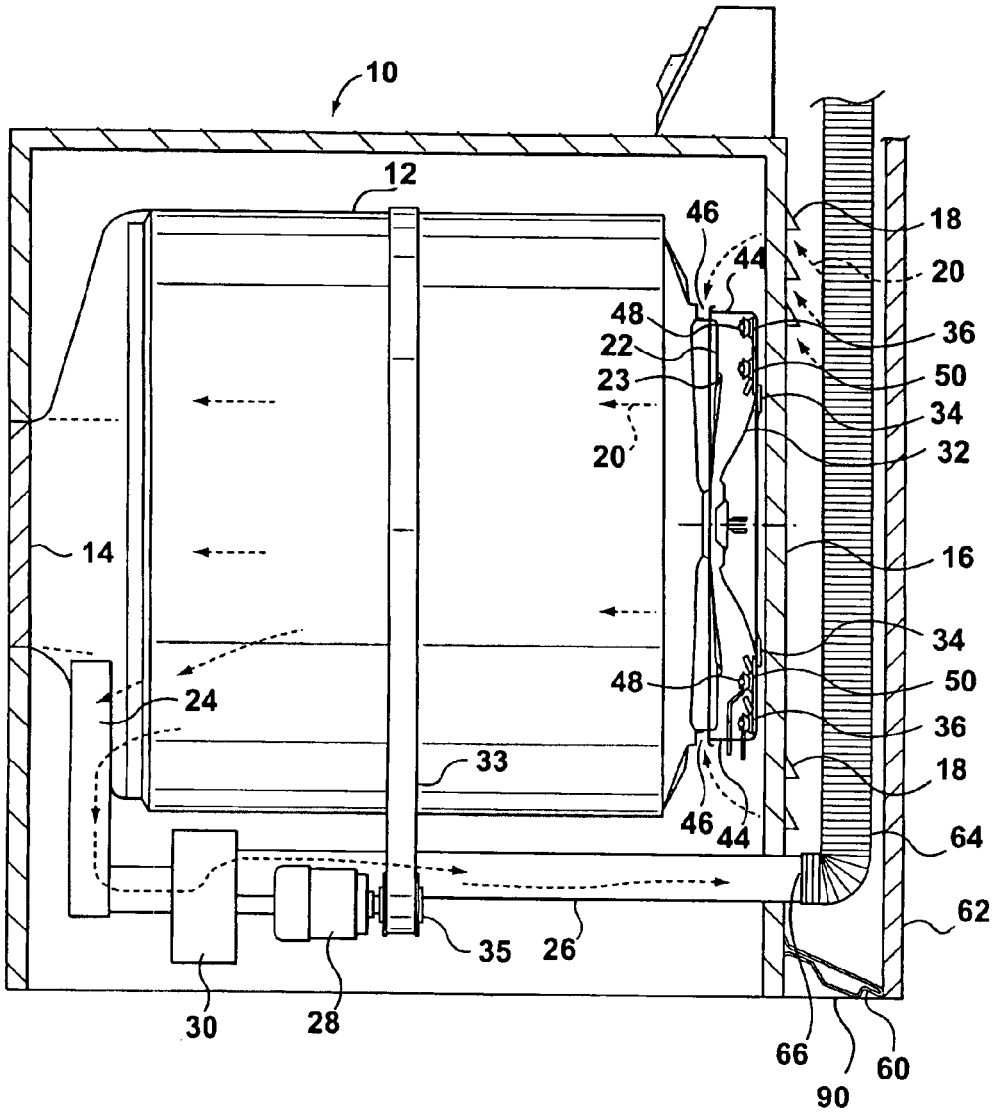
FIG. 1 is a view showing an electric clothes dryer having the spacer of the present invention attached to the dryer rear panel.

Referring to FIG. 1 there is shown a clothes dryer 10 having a rotating drum 12 mounted therein. The rotating drum 12 has an open front through which access can be gained through door 14 of the dryer 10 for the insertion and removal of clothing and other articles from the drum 12. The clothes dryer 10 has a rear panel 16 provided with a series or plurality of louvers 18 through which air may be drawn into the interior of the dryer 10. The airflow is shown by arrows 20 passing through the louvers, through a series of openings 23 in the rear end head 22 of the dryer drum 12 through front ducting 24 and out through exhaust ducting 26. Motor 28 draws or rotates fan 30 to draw the air 20 through the drum 12. The motor 28 through pulley 35 and belt 33 also causes the rotation of the dryer drum 12.

A heater housing 32 is mounted by suitable bolts 34 to the rear panel 16 of the dryer 10. The heater housing 32 is adjacent the end head 22. The heater housing 32 has a rear wall 36 that is spaced from the rear end head 22. The rear wall 36 has a diameter which is greater than the rear end head 22 inner diameter and as a result the rear wall 36 is slightly larger than the rear end head 22. The heater housing 32 has an upstanding outer peripheral wall portion 44 that extends around the periphery of the polygonal shaped rear wall 36. An air gap 46 of variable size extends between the wall portion 44 and the end head 22 of the dryer drum.

Helically wound heater coils 48 are mounted via electrical insulators 50 to the rear wall 36 of the heater housing 32. The coils 48 are spaced from the rear walls 36 and from the end head 22 of the dryer drum. The heater coils 48 are connected to a source of electrical supply through terminals (not shown). When electrical energy is fed through terminals to coils 48, the coils warm heating air passing over the coils and towards the openings 23 in the end head 22 of the dryer drum 12. While the operation of an electrically heated clothes dryer is described, it should be understood that the invention is also applicable to gas heated clothes dryers.

In accordance with the present invention the dryer rear panel 16 has a spacer 60. The spacer 60 is shown in FIG. 1 in its lowered position. The spacer 60 extends from the dryer rear panel 16 and abuts against room wall 62 limiting the movement of dryer 10 towards room wall 62. Also shown in the drawing is a flexible hose 64 mounted to the end 66 of the exhaust ducting 26 which ducting extends through the rear panel 16 of the dryer 10. The flexible hose 64 extends upward adjacent room wall 62 in the space located between the rear panel 16 and the room wall 62. It should be understood that the flexible hose 64 typically comprises an elongated plastic wrapper surrounding a helical support frame coil allowing the hose to be bent or curved. In FIG. 1, the hose 64 is shown rising vertically. The hose typically is connected to a metal vent (not shown) at the end of the hose opposite to the end connected to the vent 26. The metal vent typically passes through one of the room walls to ambient outside the room. It should be understood that the hose 64 may extend in any direction, vertical or horizontal from the exhaust vent 26 of the dryer 10.

Figure 2:
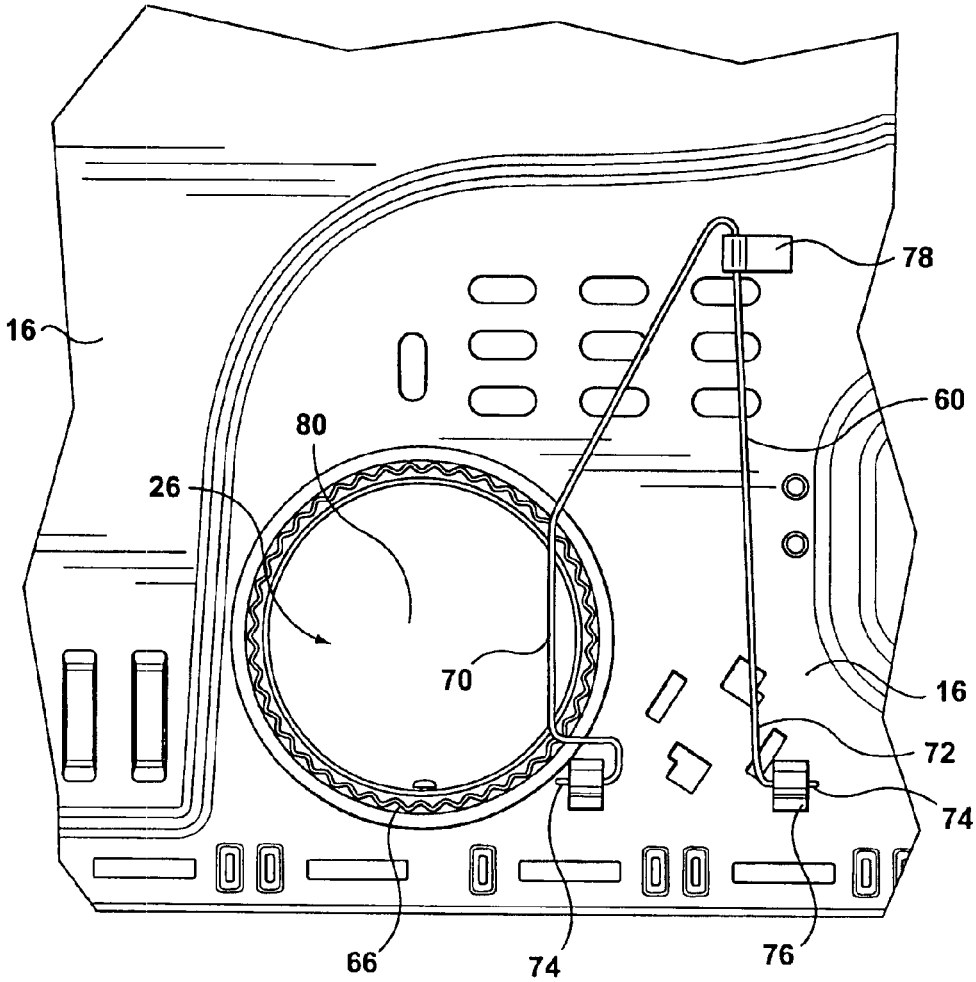
FIG. 2 is a view of the clothes dryer rear panel showing the spacer in an upright shipping position; and, FIG. 3 is a view of the spacer in its extending outward position relative to the rear panel of the clothes dryer.
Figure 3:
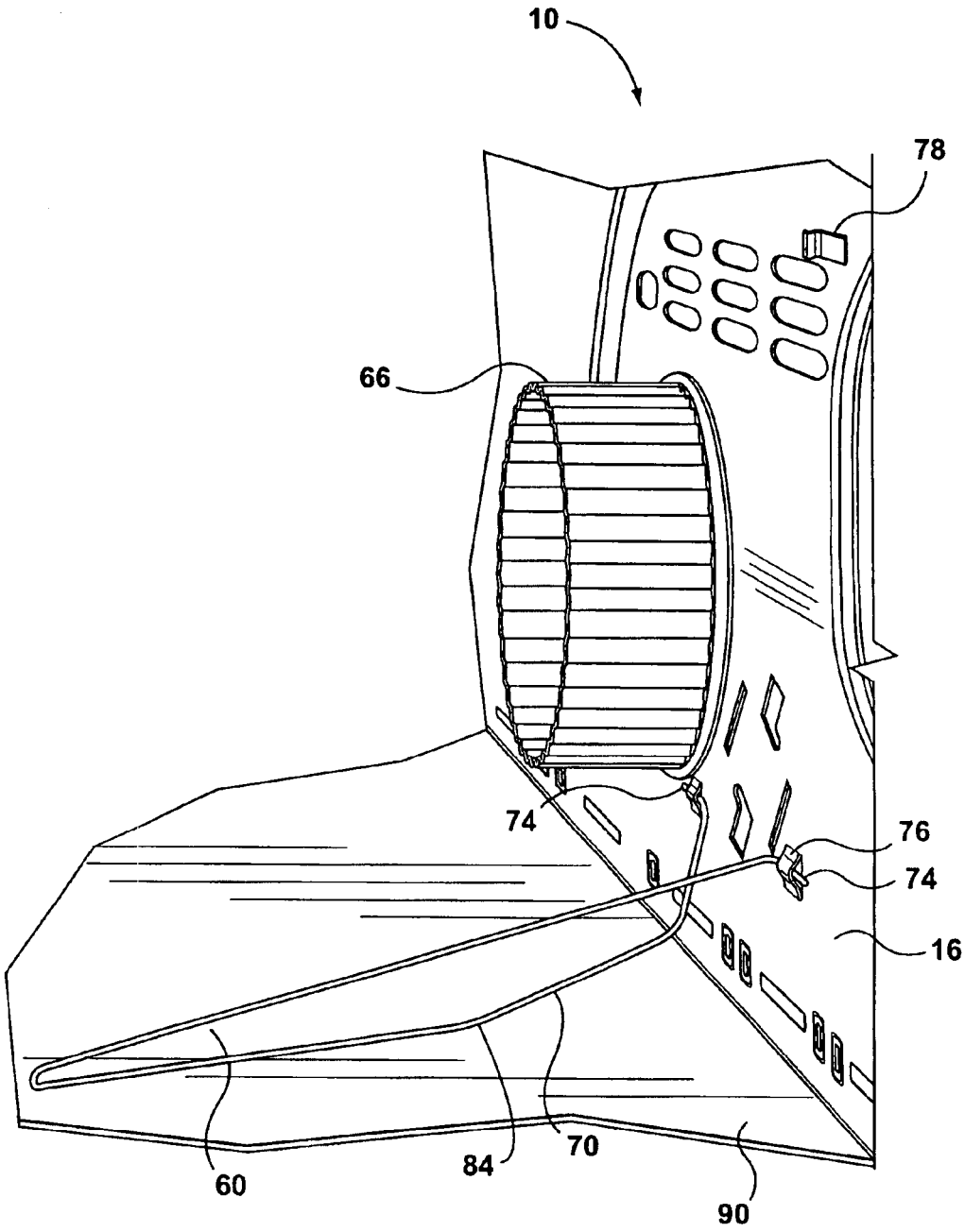

For a better understanding of the spacer 60 and how it may be mounted to the dryer rear panel 16, reference may be made to FIG. 2 and FIG. 3. In FIG. 2, the spacer 60 is shown in an upright shipping position mounted to the rear panel 16 of the dryer. By upright shipping position it should be understood that in this position the spacer can be shipped with the product and the spacer is not in its operating position. Further it should be noted that the spacer 60 has a cover portion or hook like member shown at 70 which overlaps or at least partially overlaps the end 66 of the dryer exhaust vent 26. The purpose of cover or overlapping portion 70 is to prevent the flexible hose 64 from being attached to the end 66 of the dryer venting 26 with the spacer in the upright position shown in FIG. 2.

In the upright position the spacer 60 has a first end portion 72 which includes two ears 74 which are bent relative to the remainder of the spacer 60. These ears 74 are shown attached within eyelets 76 mounted to the rear panel of the dryer. The dryer rear panel 16 may also include a latch 78 which holds or secures the other end of the spacer 60 in a upright position. Alternatively, this latch 78 may comprise a piece of tape. As shown, the ears 74 are mounted below or substantially below the center 80 of the dryer vent 66 to allow the spacer 60 to pivot the cover portion 70 away from the exhaust vent 26.

Referring to FIG. 3, the spacer 60 is shown in a lowered position extending out and away from the rear panel 16 of the dryer 10. The spacer 60 is shown with the cover portion 70 having a bent out lower leg type member 84 which is also positioned on the floor 90 on which the dryer 10 rests. In FIG. 3 the room wall 62 is not shown. The position shown in FIG. 3 is obtained by unlatching member 78 in FIG. 2 and rotating the spacer 60 about eyelets 76 into the lowered position shown in FIG. 3. When the dryer is to be placed into operation within a home, the spacer 60 may be pivoted into the position shown in FIG. 3 and then the flexible hose 64 may be attached as shown in FIG. 1. Next, the dryer is pushed towards room wall 62 and the movement of the dryer towards the rear panel 62 is limited and stopped by spacer 60 abutting room wall 62 as shown in FIG. 1. This distance between the rear panel 16 and the room wall 62 is a predetermined distance determined by the angle and length of spacer 60 as it extends away from the rear panel 16 of dryer 10. In practice, this distance is greater then the diameter of the flexible hose and is approximately 6 to 7 inches.

It should be understood that the spacer 60 may be removed by hand from the rear panel 16 when a metal exhaust vent is installed to the panel 16. The spacer 60 may be removed by squeezing the sides of the spacer 60 to move the ears 74 towards each other so as to remove the ears 74 from the eyelets 76.

It should also be understood that the spacer 60 shown in the described embodiment comprises a wire like member which may be bent into the shape shown. It should be understood that the spacer 60 may comprise a plastic or sheet metal member in alternative embodiments.

What is claimed is:

1. A clothes dryer comprising:

a rear panel, an exhaust vent passing through the rear panel and the exhaust vent being adapted for connection with a flexible venting hose; and, a spacer movably mounted to the rear panel for movement between an upright shipping position extending adjacent the dryer rear panel and a lowered position extending out and away from the dryer rear panel for maintaining a predetermined distance between the rear panel of the dryer and a room wall adjacent to which the clothes dryer is adapted to be positioned.

2. The clothes dryer of claim 1 wherein the spacer includes a cover portion that at least partially covers the exhaust vent when the spacer is in the upright position and prevents connection of the flexible venting hose to the dryer exhaust vent.

3. The clothes dryer of claim 1 wherein the spacer has two opposing end portions and is pivotally attached at one of its opposing end portions to the dryer rear panel and is adapted to pivot about the one opposing end.

4. The clothes dryer of claim 3 wherein the rear panel has two spaced apart eyelets and the spacer comprises a wire having two bent ears inserted into the eyelets for pivotal mounting to the rear panel.

5. The clothes dryer of claim 4 wherein the spacer has a cover portion bent to extend at least partially over the exhaust vent when the spacer is in the upright shipping position.

6. The clothes dryer of claim 4 wherein the rear panel of the dryer comprise a latch adapted to hold the spacer in the upright shipping position.

7. The clothes dryer of claim 1 wherein the spacer is pivotally mounted to the dryer rear panel below the dryer exhaust vent.

* * * * *